US007699100B2

(12) United States Patent
Robichaux et al.

(10) Patent No.: US 7,699,100 B2
(45) Date of Patent: Apr. 20, 2010

(54) DROPPING SUB METHOD AND APPARATUS

(75) Inventors: Terry P. Robichaux, Houma, LA (US); Kenneth G. Caillouet, Thibodaux, LA (US)

(73) Assignee: Mako Rentals, Inc., Houma, LA (US)

( * ) Notice: Subject to any disclaimer, the term of this patent is extended or adjusted under 35 U.S.C. 154(b) by 396 days.

(21) Appl. No.: 11/743,319

(22) Filed: May 2, 2007

(65) Prior Publication Data

US 2008/0271884 A1 Nov. 6, 2008

Related U.S. Application Data

(60) Provisional application No. 60/746,230, filed on May 2, 2006, provisional application No. 60/885,516, filed on Jan. 18, 2007.

(51) Int. Cl.
*E21B 33/13* (2006.01)

(52) U.S. Cl. ..... 166/193; 166/192; 166/75.15

(58) Field of Classification Search ..... 166/192, 166/193, 194, 75.15
See application file for complete search history.

(56) References Cited

U.S. PATENT DOCUMENTS

| | | | | |
|---|---|---|---|---|
| 2,713,909 | A | 7/1955 | Baker | |
| 2,961,045 | A | 11/1960 | Stogner et al. | |
| 2,961,046 | A | 11/1960 | Moeller et al. | |
| 3,403,729 | A | 10/1968 | Hickey | |
| 3,545,542 | A * | 12/1970 | Scott | 166/155 |
| 3,616,850 | A | 11/1971 | Scott | |
| 4,235,021 | A | 11/1980 | Claycomb | |
| 4,317,486 | A | 3/1982 | Harris | |
| 4,427,065 | A | 1/1984 | Watson | |
| 4,624,312 | A | 11/1986 | McMullin | |
| 4,671,353 | A | 6/1987 | Daming | |
| 4,722,389 | A | 2/1988 | Arnold | |
| RE33,150 | E | 1/1990 | Boyd | |
| 4,907,649 | A | 3/1990 | Bode | |
| 4,917,184 | A | 4/1990 | Freeman et al. | |
| 4,995,457 | A | 2/1991 | Baldridge | |
| 5,095,988 | A | 3/1992 | Bode | |
| 5,205,359 | A | 4/1993 | Stephenson | |
| 5,435,390 | A | 7/1995 | Baugh et al. | |
| 5,443,122 | A | 8/1995 | Brisco | |
| 5,494,107 | A | 2/1996 | Bode | |
| 5,722,491 | A | 3/1998 | Sullaway et al. | |
| 5,829,523 | A | 11/1998 | North | |
| 5,833,002 | A | 11/1998 | Holcombe | |
| 5,890,537 | A | 4/1999 | Lavaure et al. | |
| 5,890,538 | A | 4/1999 | Beirute et al. | |
| 5,950,724 | A * | 9/1999 | Giebeler | 166/70 |
| 5,960,881 | A | 10/1999 | Allamon et al. | |
| 6,206,095 | B1 | 3/2001 | Baugh | |
| 7,134,505 | B2 * | 11/2006 | Fehr et al. | 166/387 |
| 2005/0039925 | A1 | 2/2005 | Connell | |
| 2005/0247458 | A1 | 11/2005 | Stevens et al. | |

* cited by examiner

*Primary Examiner*—David J Bagnell
*Assistant Examiner*—Sean D Andrish
(74) *Attorney, Agent, or Firm*—Garvey, Smith, Nehrbass & North, L.L.C.; Brett A. North

(57) ABSTRACT

In one embodiment a method and apparatus for an improved loading sub method and apparatus is disclosed. In one embodiment the method and apparatus can be used to pump various pump down means into the well bore from the rig.

9 Claims, 17 Drawing Sheets

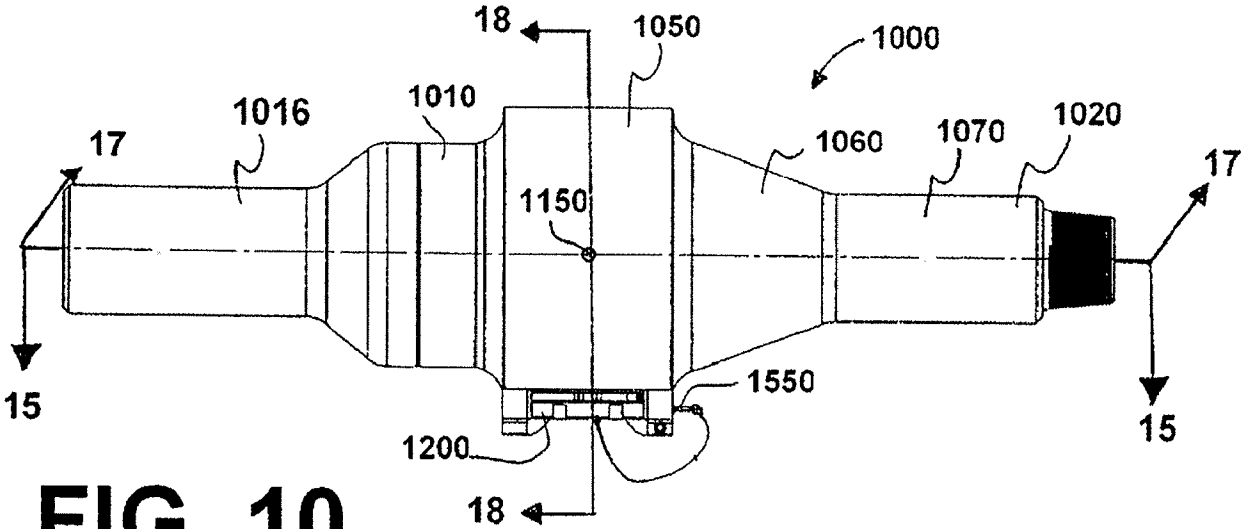
FIG. 10
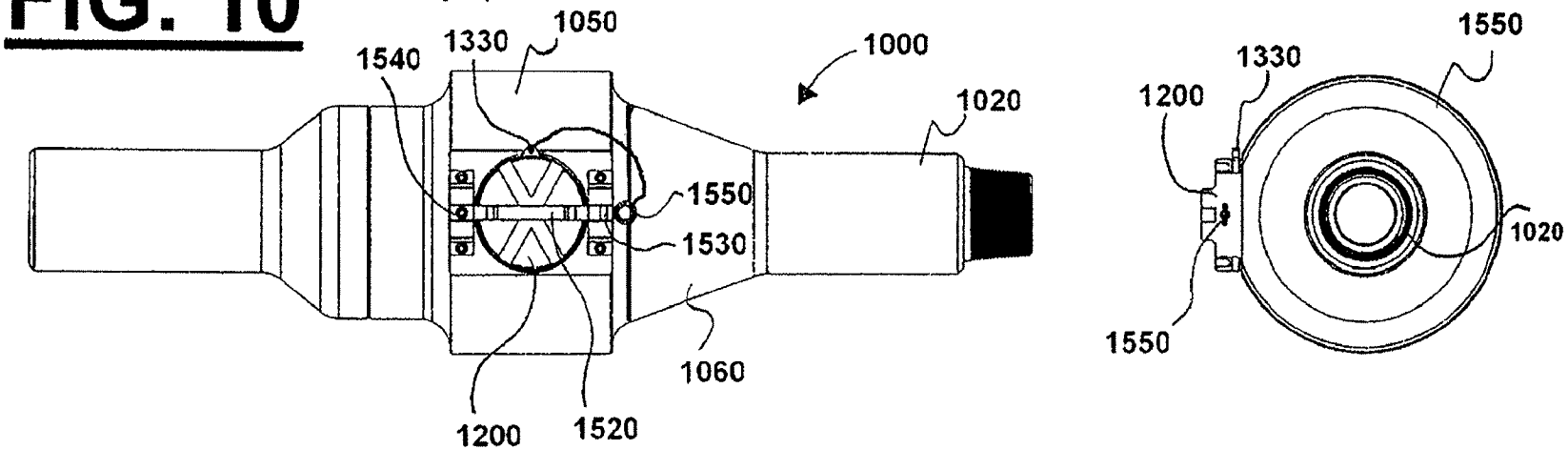
FIG. 11
FIG. 12

DROPPING SUB METHOD AND APPARATUS

CROSS-REFERENCE TO RELATED APPLICATIONS

U.S. Provisional Patent application Ser. No. 60/746,230, filed 2 May 2006, is incorporated herein by reference.

Priority of U.S. Provisional Patent application Ser. No. 60/746,230, filed 2 May 2006, is hereby claimed.

U.S. Provisional Patent application Ser. No. 60/885,516, filed 18 Jan. 2007, is incorporated herein by reference.

Priority of U.S. Provisional Patent application Ser. No. 60/885,516, filed 18 Jan. 2007, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The invention relates to an apparatus and method for holding and mechanically releasing a pump down means, such as a ball or wiper plug element, such as during cementing operations of a subterranean oil or gas well or during other oil and/or gas operations.

As a step in the completion operation of a subterranean well, a casing is run into the well and the annular area exterior of the casing and within the open bore thereafter is cemented to secure the casing within the well. Cementing plugs, wiper balls, ball elements, and other pump down means are utilized in the cementing operation and are run ahead and behind the cement slurry in order to wipe mud off the walls of the casing or drill pipe and to prevent cement from being contaminated with the drilling fluid previously circulated within the casing and the well. Such plugs are often run into the well within the casing and behind a cement slurry in order to wipe the casing inner diameter and close off check valves, open stage collars, and close again stage collars during multi-stage cementing operations, and the like.

In the past, the connection between a cementing swivel and top drive unit has been broken, and a pump down means which is larger than the internal diameter of the drill string, and larger than the opening of the box end connection, has been inserted into the drill string using physical force, such as by beating the pump down means with a hammer, and then the cementing swivel is reconnected to the top drive unit, and afterwards the pump down means is pumped downhole. This prior art method suffers from the disadvantage of damaging the box end threads, damaging the pump down means, and further limiting the maximum size for the pump down means which is "beat" into the drill string.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment is provided a method and apparatus for inserting, holding, and mechanically releasing a pump down means, such as a wiper plug, wiper ball, valve activating ball element, dart, or the like used during the cementing or other remedial operation of or within a conduit within a subterranean well.

In one embodiment the apparatus is securable on a longitudinally and rotationally manipulable conduit member (such as a swivel) communicating with the well such that no hydraulic auxiliary control lines extend from the apparatus.

In one embodiment, the apparatus includes an enlarged area for holding a pump down means, such enlarged area including a transitional area of reduced volume for at least temporarily restricting downhole movement of the pump down means.

In one embodiment, items of different sizes and/or shapes can be pumped into a drill or well string using the method and apparatus of the present invention.

In one embodiment, items of different sizes and/or shapes are sequentially pumped into a drill or well string using the method and apparatus of the present invention.

In one embodiment, a plurality of items are simultaneously pumped into a drill or well string using the method and apparatus of the present invention.

In one embodiment, a plurality of items of different sizes and/or shapes are simultaneously pumped into a drill or well string using the method and apparatus of the present invention.

In one embodiment is disclosed a method of inserting a pump down means into a drill or well string comprising the steps of loading a pump down means in a loading sub housing, placing the loaded loading sub housing in fluid communication with a downhole drill or well string, applying an upstream pressure and causing the pump down means to exit the sub housing and enter the downhole drill or well string. In one embodiment the loading sub housing is fluidly connected to a top drive unit and the top drive unit applies the upstream pressure.

In one embodiment is disclosed a method of inserting a pump down means into a drill or well string comprising the steps of placing an unloaded loading sub housing in fluid communication with a downhole drill or well string, performing at least part of a cementing operation, breaking the connection between the loading sub housing and the drill or well string, inserting a pump down means into the loading sub housing, and reconnecting the now loaded loading sub housing with the drill string, applying an upstream pressure and causing the pump down means to exit the sub housing and enter the downhole drill or well string. In one embodiment the loading sub housing is fluidly connected to a top drive unit and the top drive unit applies the upstream pressure.

In one embodiment the method and apparatus comprises a cylindrical housing with an enlarged area for receipt of a pump down means, and a reduced area downstream of the enlarged area wherein the pump down means is pushed by applying an upstream pressure to the cylindrical housing.

In one embodiment a restricting element is provided which can detachably connect/temporarily restrict a drop down means such as when a sufficient differential pressure/fluid flow is applied against drop down means until drop down means overcomes the restricting forces of restricting element. In one embodiment restricting element can be a sheet which can fail at a preset pressure. In one embodiment restricting element can be a flexible member (such as an arm or sheet with radial cutouts) which apply a restricting force which can be overcome.

In one embodiment, the apparatus includes American Petroleum Institute (API) threads at both the upper and lower ends of the cylindrical housing.

In one embodiment, the upper end of the cylindrical housing includes a box connection and the lower end of the housing includes a pin connection.

In one embodiment, the transition from the enlarged area to the reduced area is frustoconical or funneled.

In one embodiment, the transition from the enlarged area to the reduced area is parabolic.

In one embodiment, the transition from the enlarged area to the reduced area is curvilinear.

In one embodiment, the transition from the enlarged area to the reduced area is smooth.

In one embodiment, the transition from the enlarged area to the reduced area contains no sharp edges.

In one embodiment, the enlarged area is located between the termination of the threads in the upper end of the housing and the reduced area.

In one embodiment, the enlarged area includes the threads in the upper end of the housing.

In one embodiment, the enlarged area includes the transition area.

In one embodiment, the enlarged area is large enough to contain the pump down means without compressing the pump down means.

In one embodiment the reduced area has substantially the same cross sectional area as the cross sectional area of the downhole drill string.

In one embodiment, the pump down means is compressed when making the transition from the enlarged area to the reduced area.

In one embodiment, the pump down means is made of an elastomeric material, such as rubber, plastic, sponge, polymer, or other elastomeric materials.

In one embodiment, the pump down means is comprised of a compressible material.

In one embodiment the pump down means is made of a drillable material.

In one embodiment, the step of positioning preferably comprises attaching the loading sub housing to a top drive unit and lowering the loading sub housing with the top drive unit toward the well.

In one embodiment the method includes the additional step of checking to determine whether the pump down means failed to activate a downhole tool and then pumping a second item to activate the downhole tool.

In one embodiment, a means of circulating fluids through the drill string prior to, and after release of, the pump down means, is provided.

In one embodiment a down-hole catcher is used to catch the pump down means.

In one embodiment a down-hole catcher is used to ultimately retrieve the pump down means.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 10 shows another alternative loading sub having a side entry port.

FIG. 11 shows the loading sub of FIG. 10 wherein the sub has been rotated ninety degrees along its longitudinal axis.

FIG. 12 shows a top view of the loading sub of FIG. 10.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
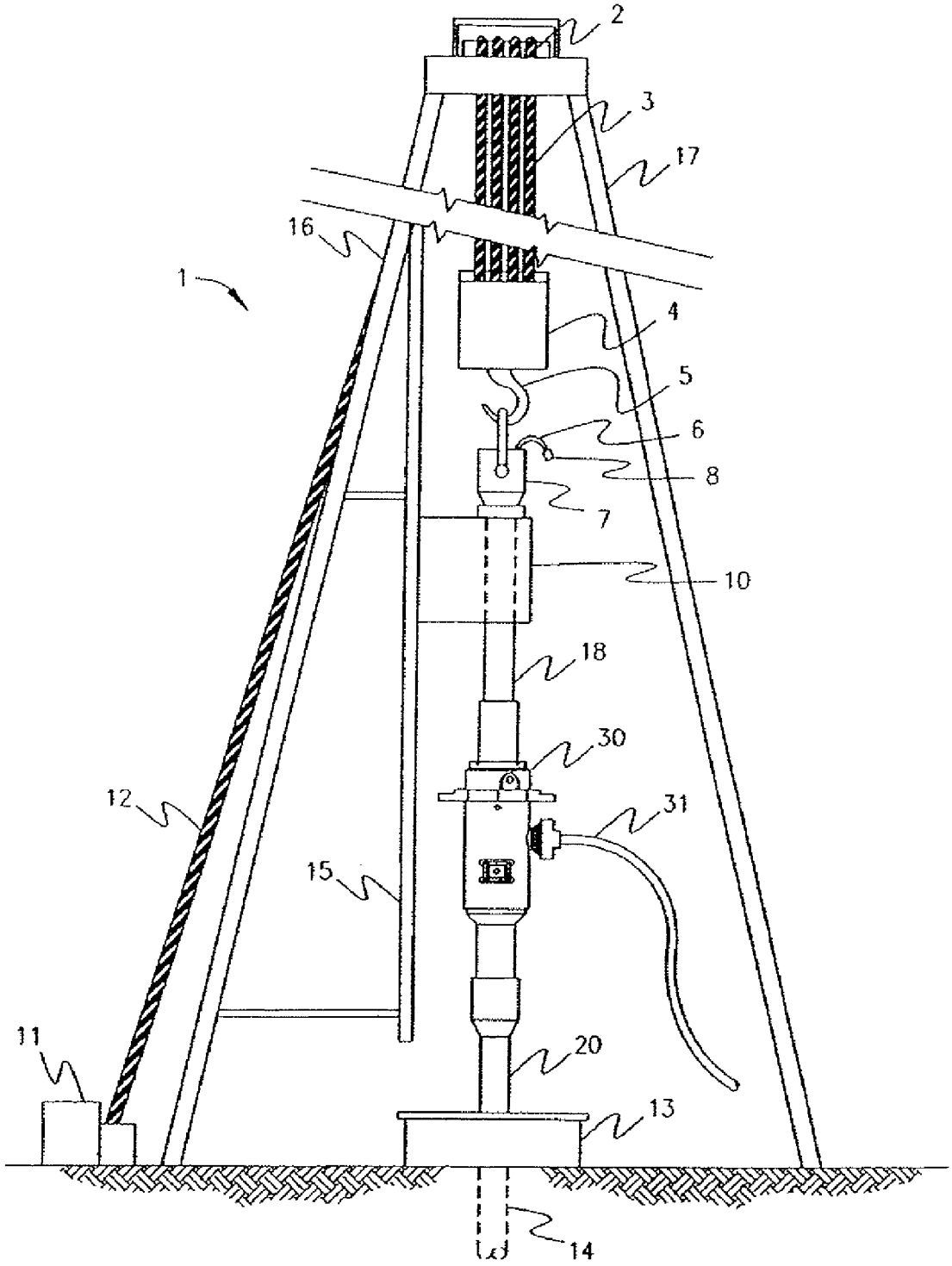
FIG. 1 is a schematic view showing a top drive rig with a top drive swivel.

FIG. 1 is a schematic view showing a top drive rig 1 with a top drive swivel 30 incorporated into drill string 20. FIG. 1 is shows a rig 1 having a top drive unit 10. Rig 5 comprises supports 16,17; crown block 2; traveling block 4; and hook 5. Draw works 11 uses cable 12 to move up and down traveling block 4, top drive unit 10, and drill string 20. Traveling block 4 supports top drive unit 10. Top drive unit 10 supports drill string 20. During drilling operations, top drive unit 10 can be used to rotate drill string 20 which enters wellbore 14. Top drive unit 10 can ride along guide rails 15 as unit 10 is moved up and down. Guide rails 15 prevent top drive unit 10 itself from rotating as top drive unit 10 rotates drill string 20. During drilling operations drilling fluid can be supplied downhole through drilling fluid line 8 and gooseneck 6.

At various times top drive operations, beyond drilling fluid, require substances to be pumped downhole, such as cement, chemicals, epoxy resins, or the like. In many cases it is desirable to supply such substances at the same time as top drive unit 10 is rotating and/or moving drill or well string 20 up and/or down and bypassing top drive unit 10 so that the substances do not damage/impair top drive unit 10. This can be accomplished by using top drive swivel 30.

As a step in the completion operation of well 14, a casing is run into well bore 14 and the annular area exterior of the casing and within the open bore thereafter is cemented to secure the casing within well bore 14. Cementing plugs, wiper balls, ball elements, and other pump down means can be used in the cementing operation and can be run ahead and behind the cement slurry in order to wipe mud off the walls of the casing or drill pipe 20 and to prevent cement from being contaminated with the drilling fluid previously circulated within the casing and well bore 14. Such plugs are often run into well bore 14 within the casing and behind a cement slurry in order to wipe the casing inner diameter and close off check valves, open stage collars, and reclose stage collars during multi-stage cementing operations, and the like. In one embodiment, a loading sub housing 100 is provided for inserting and pumping a pump down means.

Figure 2:
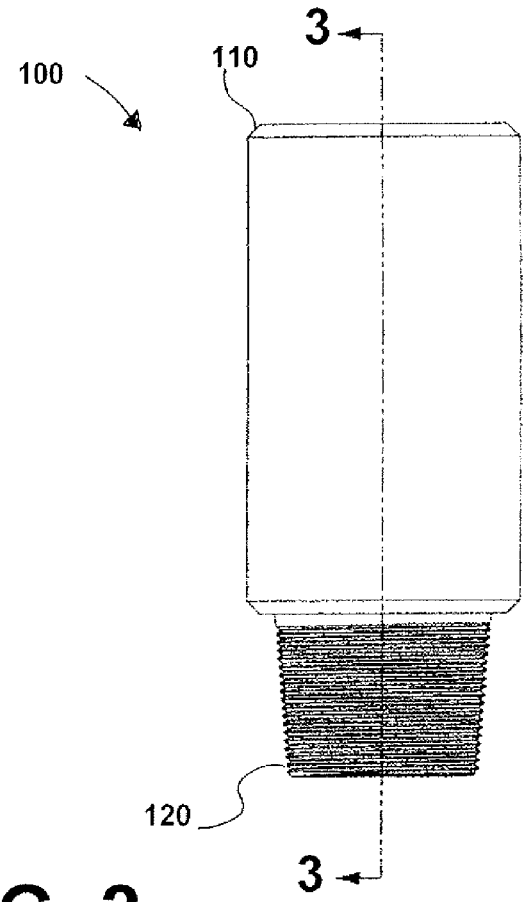
FIG. 2 is a side view of one embodiment of a loading sub housing.
Figure 3:
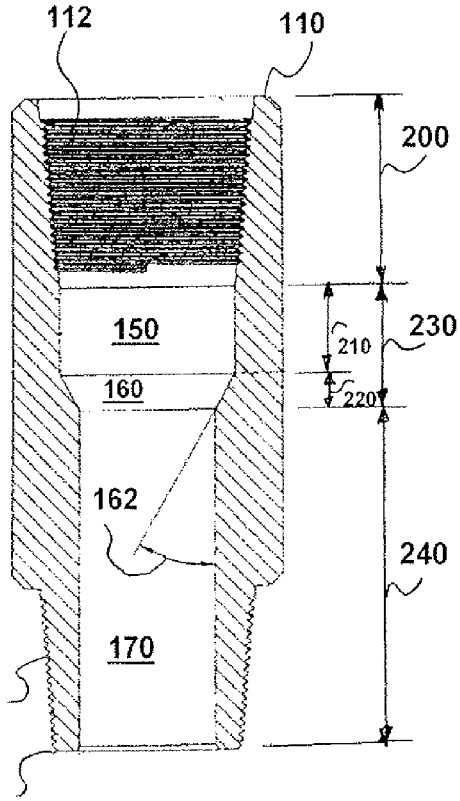
FIG. 3 is a section view of the loading sub housing of FIG. 2 taken along the lines 3-3.
Figure 4:
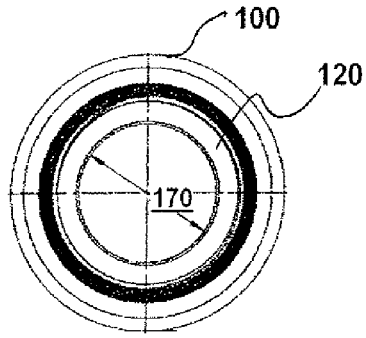
FIG. 4 is a bottom end view of the loading sub housing of FIG. 2.

FIG. 2 is a side view of one embodiment of a loading sub housing 100. FIG. 3 is a sectional view of loading sub housing 100 taken along the lines 3-3. FIG. 4 is an end view of loading sub housing 100. Loading sub housing 100 can comprise upper end 110, lower end 120, enlarged area 150, transition area 160, and reduced area 170.

Enlarged area 150 can be large enough to accept a pump down means 300 by hand insertion. Enlarged area 150 can include transition area 160. In such a case enlarged area 150 would be indicated by dimension lines 210,220. Enlarged area can also include threaded area 112. In such a case enlarged area 150 would be indicated by dimension lines 200,210. Enlarged area 150 can include both threaded area 112 and transition area 160. In such a case enlarged area would be indicated by dimension lines 200,230.

Preferably, transition area 160 transitions from enlarged area 150 to reduced area 170. Preferably, transition area 160 is frustoconically shaped with rounded edges to facilitate movement of pump down means 300 into reduced area 170 and downstream of loading sub housing 100. Preferably, transition area 160 has an angle 162 of 30 degrees. In other embodiments the transition from enlarged area 150 to reduced area 170 can be funneled, parabolic, curvilinear, and/or smooth. In other embodiments the transition is shaped to ease transition to reduced area 170.

In one embodiment the following dimensions can be used: overall longitudinal length of sub 100 being 20 inches (50.8 centimeters)(dimension 200,230,240); longitudinal length of threaded area 122 being 5 inches (12.7 centimeters); the difference between the overall length and the length of threaded area 122 being 15 inches (38.1 centimeters); and the length of dimension 200 plus 210 being 8.49 inches (21.56 centimeters). Overall external diameter being 8.5 inches (21.59 centimeters); internal diameter of enlarged area 150 being 5.5 inches (13.97 centimeters); and internal diameter of reduced area 170 being 4.25 inches (10.8 centimeters). The pin end can be a 6.625 FH connection. Box end can be a 6.625 FH box connection.

Figure 5:
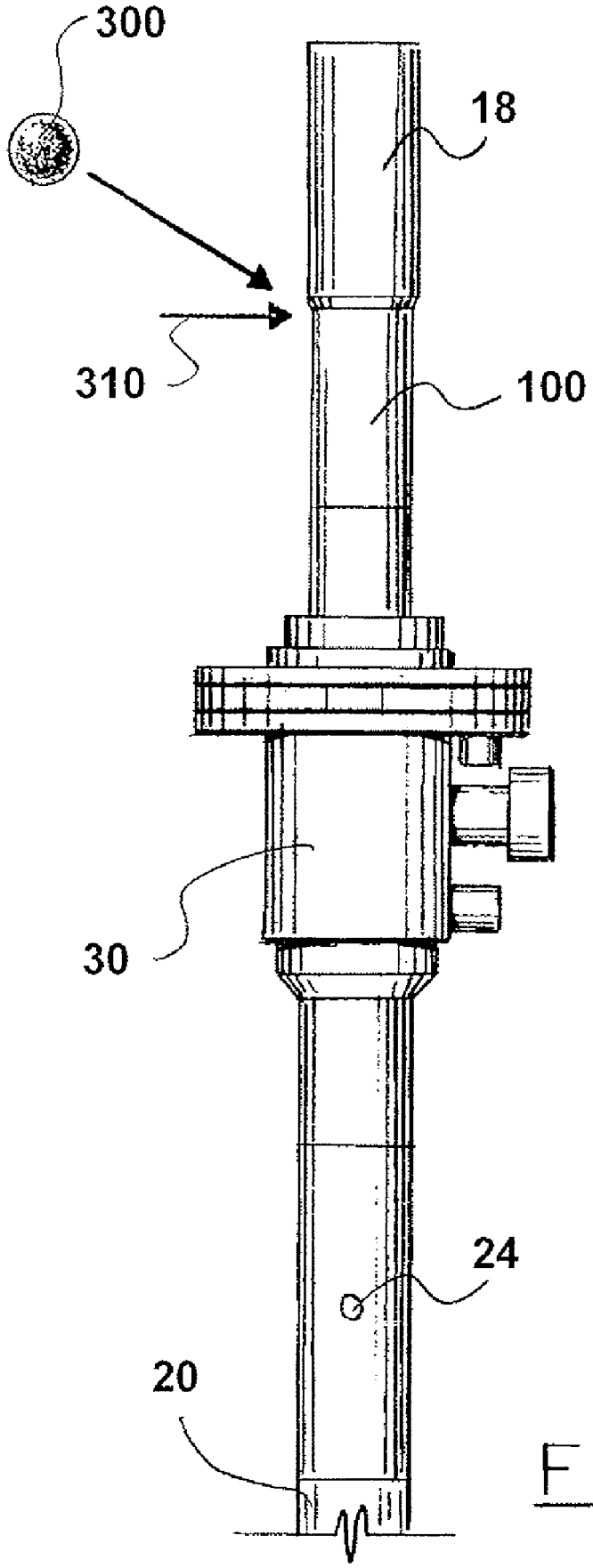
FIG. 5 is a schematic view indicating a pump down means having been inserted into the loading sub housing of FIG. 2, where the loading sub housing is placed upstream of a top drive swivel.

FIG. 5 is a schematic diagram indicating that a pump down means 300 being inserted into loading sub housing 100,where loading sub housing 100 is placed upstream of top drive swivel 30. Loading sub housing 100 can be placed between swivel 300 and upper drill pipe 18. To connect loading sub housing 100 with drill or well string 20, string 20 can be broken, such as at point 310. Loading sub housing 100 with pump down means 300 can be connected to drill or well string 20, and string 20 is reconnected. After being connected to drill or well string 20, an upstream pressure can be applied (such as through the top drive unit 10) to force pump down means 300 to move downstream. To prevent leaks valves can be placed both upstream and down stream of the point at which loading sub 100 is to be placed in drill string 20.

In one embodiment is provided a method and apparatus for inserting a pump down means 300 into drill or well string 20 comprising the steps of loading pump down means 300 in loading sub housing 100, placing the loaded loading sub housing 100 in fluid communication with a downhole drill or well string 20, applying an upstream pressure and causing the pump down means 300 to exit the sub housing 100 and enter the downhole drill or well string 20. In one embodiment loading sub housing 100 is fluidly connected to a top drive unit 10 and the top drive unit 10 applies the upstream pressure.

In one embodiment is provided a method and apparatus for inserting a pump down means 300 into a drill or well string 20 comprising the steps of placing an unloaded loading sub housing 100 in fluid communication with a downhole drill or well string 20, performing at least part of a cementing operation, breaking the connection between the loading sub housing 100 and the drill or well string 20, inserting a pump down means 300 into the loading sub housing 100, and reconnecting the now loaded loading sub housing 100 with the drill or well string 20, applying an upstream pressure and causing the pump down 300 means to exit the sub housing 100 and enter the downhole drill or well string 20. In one embodiment loading sub housing 100 is fluidly connected to a top drive unit 10 and the top drive 10 unit applies the upstream pressure.

Pump down means 300 can be an elastomeric ball, such as rubber, polymer, or other materials which are sufficiently flexible, pliable, and/or durable. Pump down means can be balls, darts, wiper plugs, wiper balls, valve activating ball elements, darts, or the like used during the cementing or other remedial operation of or within a conduit within a subterranean well. In one embodiment pump down means 300 is an elastomeric wiper ball of 5½ inch (13.97 centimeters) nominal diameter.

Figure 7:
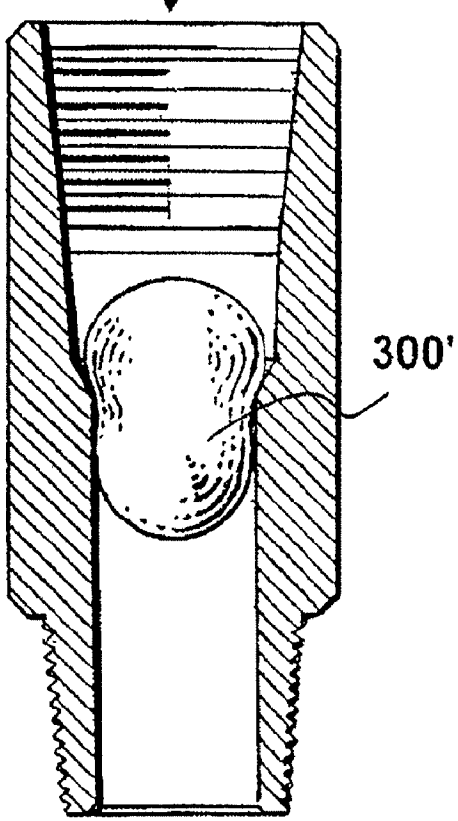
FIG. 7 schematically illustrates pressure being applied upstream to push the pump down means into the transition area and partially into the reduced area portion.
Figure 6:
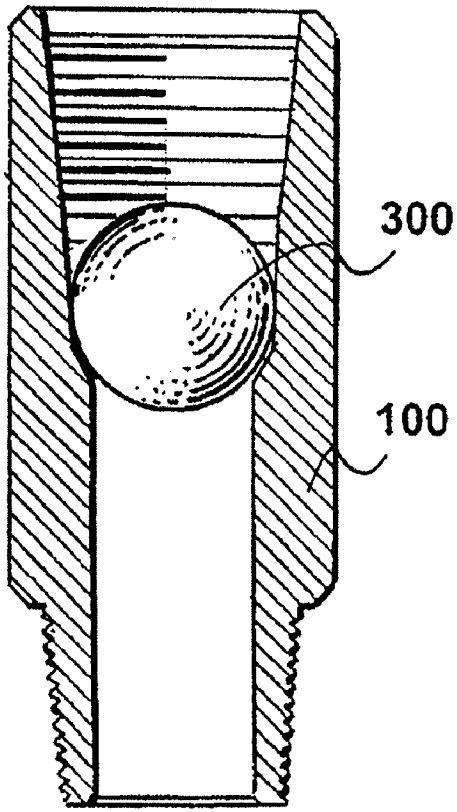
FIG. 6 shows the loading sub housing of FIG. 2 with a pump down means inserted in the enlarged area.
Figure 8:
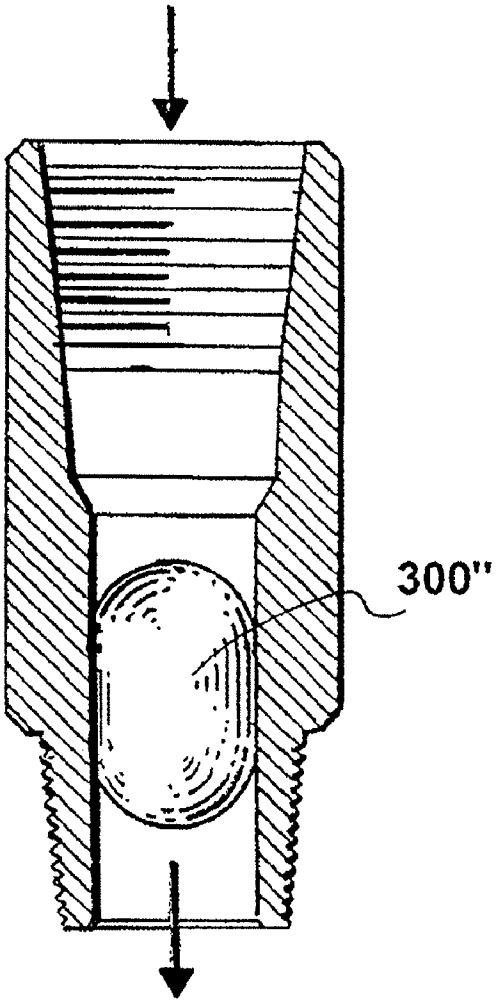
FIG. 8 schematically illustrates continued pressure being applied to push the pump down means into the reduced area.

FIGS. 6-8 schematically illustrate the process of applying pressure to cause pump down means 300 to travel from enlarged area 150, downstream and into drill string 20. FIG. 6 shows loading sub housing 100 with pump down means 300 placed in enlarged area 150. FIG. 7 schematically illustrates pressure being applied upstream to push pump down means 300' into transition area 160. FIG. 8 schematically illustrates continued upstream pressure being applied to push pump down means 300" into reduced area 170 and ultimately into downstream drill string 20. Because pump down means 300 is pliable, it is squeezed and conforms to the shape of the internal diameter of drill string 20.

In one embodiment, pump down means 300 of different sizes and/or shapes can be pumped through loading sub housing 100. In one embodiment, pump down means 300 of different sizes and/or shapes are sequentially pumped through the apparatus. In one embodiment, a plurality of pump down means 300 are simultaneously pumped through loading sub housing 100. In one embodiment, a plurality of pump down means 300 of different sizes and/or shapes are simultaneously pumped through loading sub housing 100.

In one embodiment a method of inserting a pump down means 300 into a drill or well string 20 comprising the steps of loading a pump down means 300 in a loading sub housing 100, placing the loaded loading sub housing 100 in fluid communication with a downhole drill string 20, applying an upstream pressure causing pump down means 300 to exit the sub housing 100 and enter the downhole drill string 20.

In one embodiment loading sub housing 100 is placed unloaded in drill string 20 and, subsequent to cementing activities, drill string 20 is broken and pump down means 300 inserted into loading sub housing 100, and drill string 20 is reconnected. Subsequently, pressure is applied causing pump down means 300 to move downstream in drill string 20.

In one embodiment, loading sub housing 100 includes API threads at both its upper 110 and lower 120 ends.

In one embodiment, upper end 110 of the cylindrical housing 100 includes a box connection and the lower end 120 of housing 100 includes a pin connection.

In one embodiment, enlarged area 150 is large enough to contain pump down means 300 without compressing pump down means 300.

In one embodiment, pump down means 300 is at least slightly compressed when making the transition from enlarged area 150 to reduced area 170.

In one embodiment reduced area 170 has substantially the same cross sectional area as downhole drill or well string 20.

Figure 9:
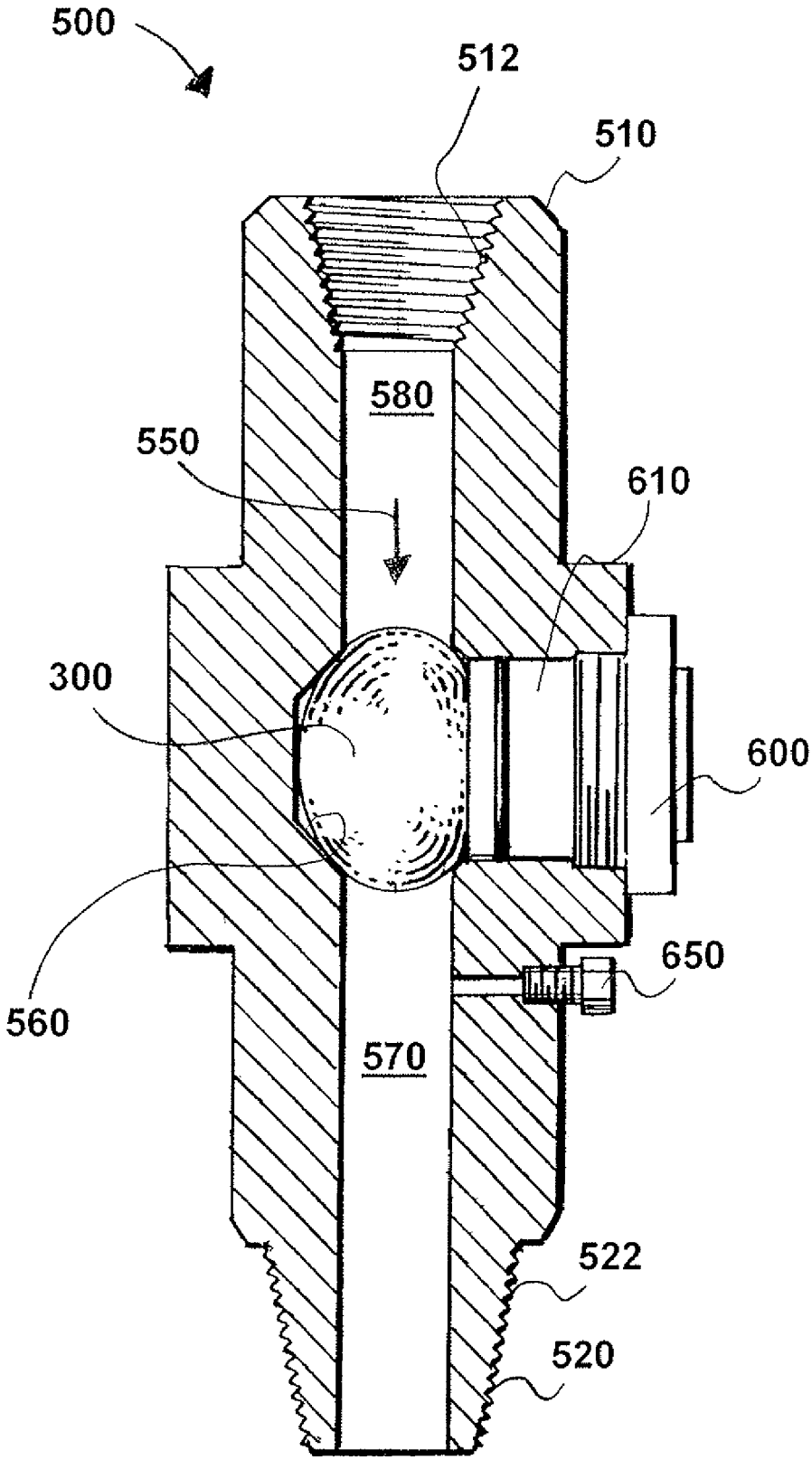
FIG. 9 schematically illustrates an alternative loading sub housing having a side entry port.

FIG. 9 schematically illustrates an alternative loading sub housing 500 having a side entry port 610. Loading sub housing 500 can comprise upper end 510, threaded area 512, lower end 520, threaded area 522, enlarged area 550, transition area 560, reduced area 570, upper area 580, side entry port 610, side entry cap 600, and bleeder valve 650. Using loading sub housing 500 pump down means 300 can be placed in sub 500 while sub 500 is connected to drill or well string 20. Side entry cap 600 can include a seal as shown in FIG. 9.

Although pump down means 300 is shown in FIG. 9 as being squeezed or deformed, enlarged area 550 and side entry port 610 can be sized such that pump down means can be inserted and without deformation and/or deflection of pump down means 300. Transition area 560 can be constructed similar to transition area 160 of loading sub housing 100. Upper area 580 is shown smaller than enlarged area 560 and approximately equal to reduced area 570. Sizing upper area 580 in this manner allows the connection at upper end 510 to be sized to fit connections for drill or well string 20. However, if desired upper area can be as large or larger than enlarged area 560.

Pump down means can be inserted into enlarged area 550 by removal of side entry cap 600. Side entry cap 600 can be threadably connected to sign entry port 610 and provide a seal when tightened. An o-ring can be used to assist in making a seal. To minimize any fluid leakage from above or below loading sub housing 500, valves can be placed both above and below sub housing 500. To reduce any latent pressure in the line, before removing side entry cap 600, bleeder valve 650 can be used to relieve pressure inside sub housing 500.

Loading sub housing 500 can be used in any of the previous method and/or apparatus embodiments.

Figure 13:
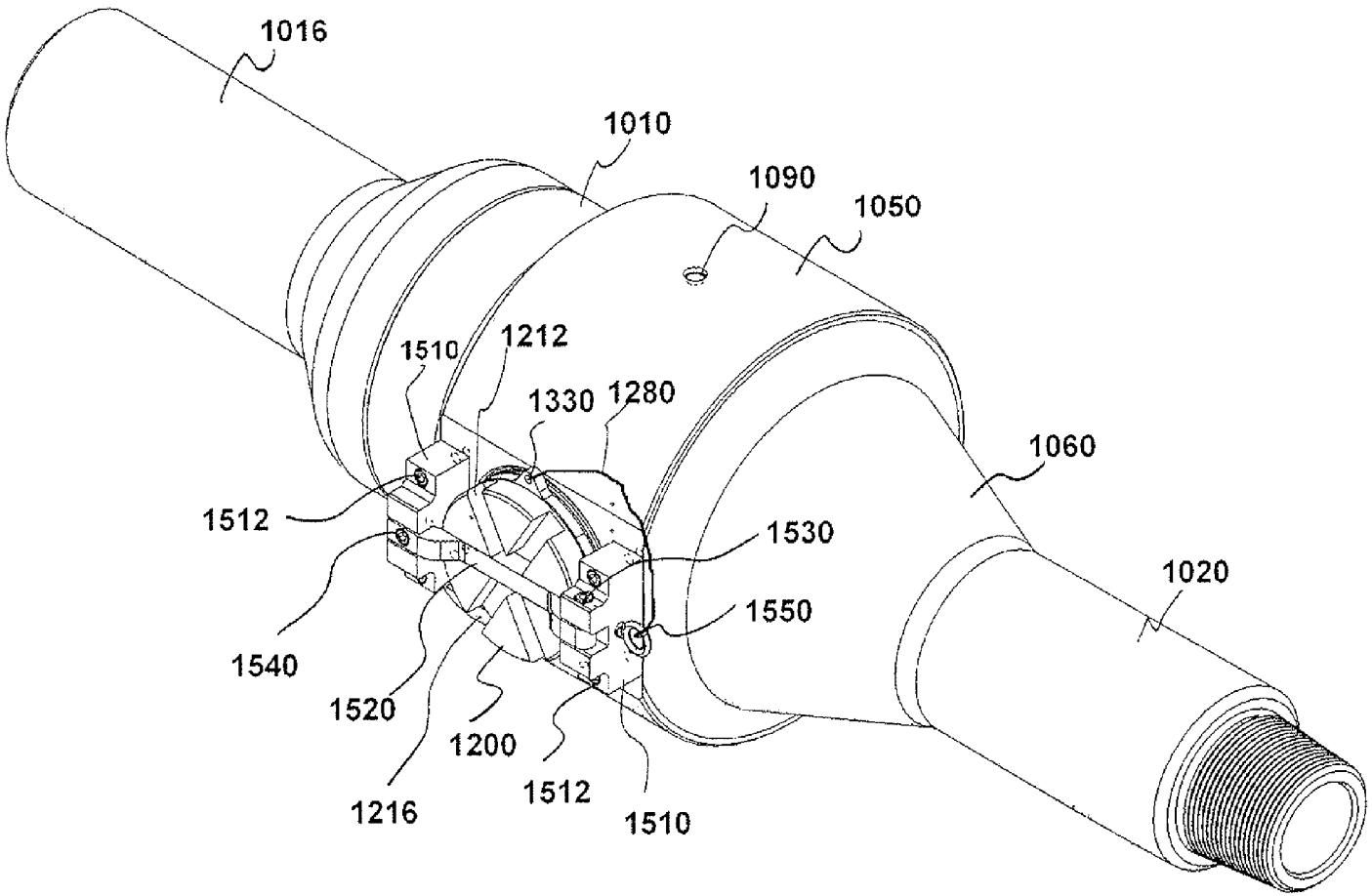
FIG. 13 shows a perspective view of the loading sub of FIG. 10.
Figure 14:
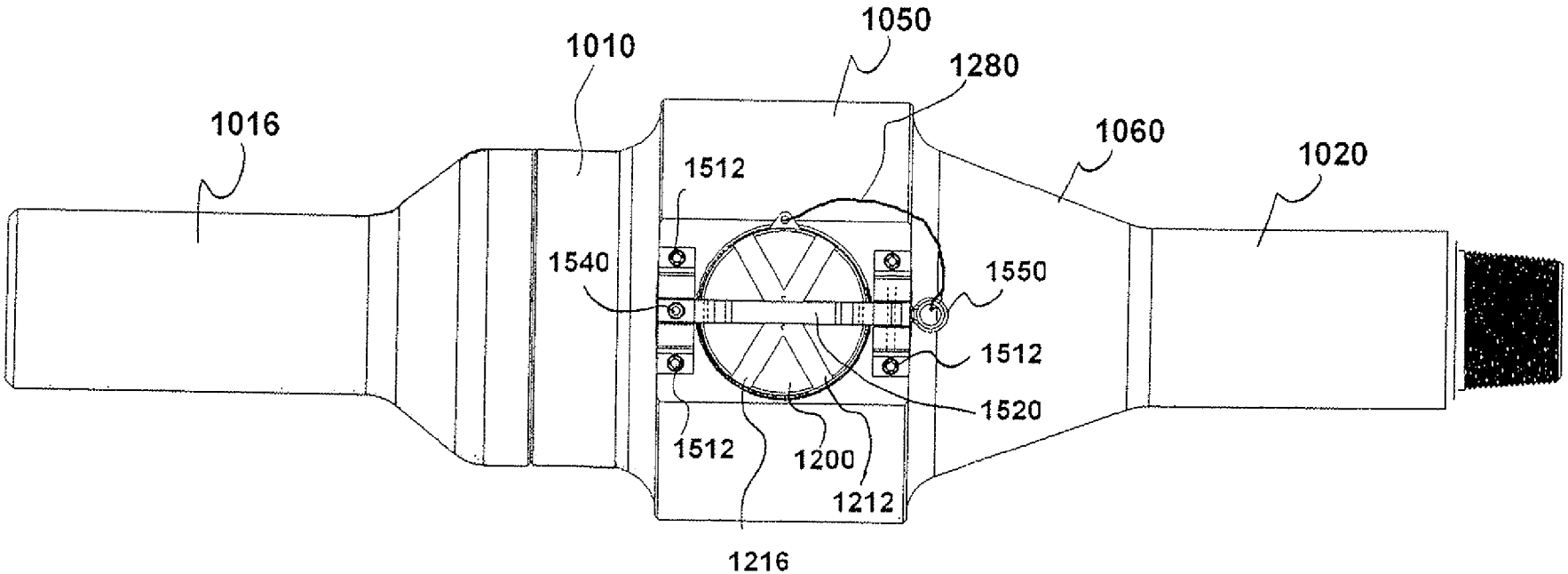
FIG. 14 shows an enlarged side view of the loading sub of FIG. 11.
Figure 18:
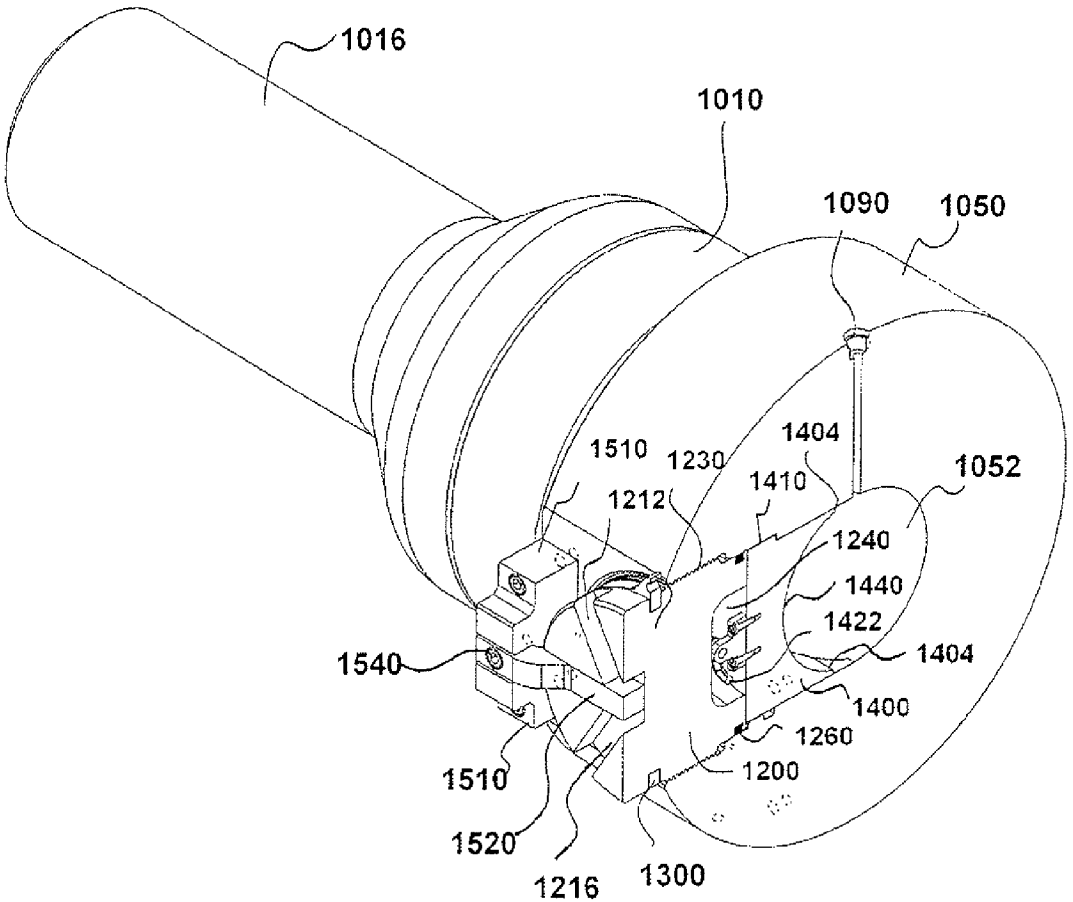
FIG. 18 shows a perspective sectional view of the loading sub of FIG. 10 taken along the lines 18-18.
Figure 19:
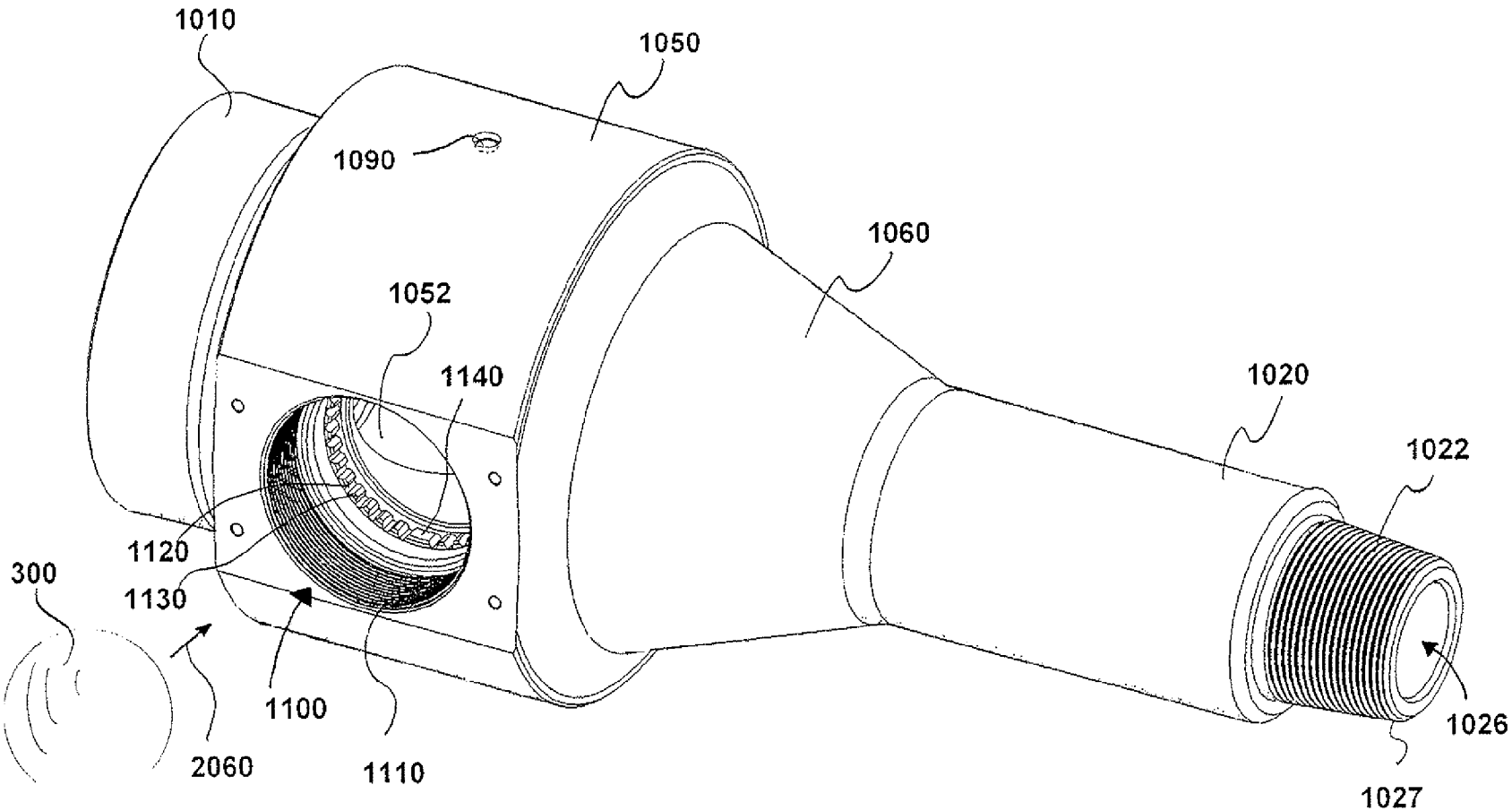
FIG. 19 shows a perspective view of the loading sub housing with the cap, insert, and top sub portion removed.

FIGS. 10 through 23 show another alternative loading sub 1000 having a side entry port 1100 (side entry port 1100 being shown in FIG. 19). FIG. 11 shows loading sub 1000 wherein the sub has been rotated ninety degrees along its longitudinal axis. FIG. 12 shows a top view of loading sub 1000. FIG. 13 shows a perspective view of loading sub 1000. FIG. 14 shows a side view of loading sub 1000.

Figure 15:
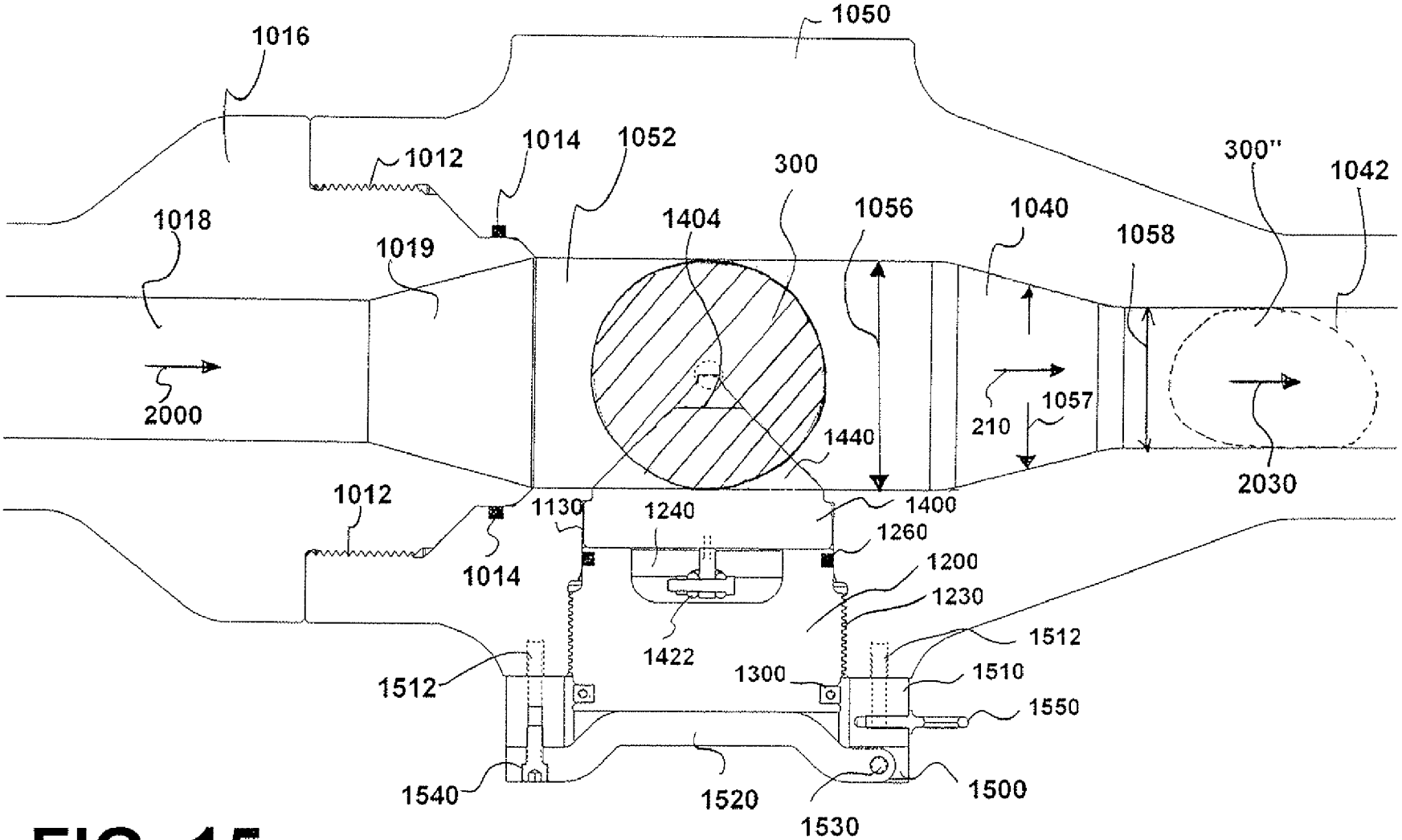
FIG. 15 shows a sectional view of the loading sub of FIG. 10 taken along the lines 15-15.
Figure 16:
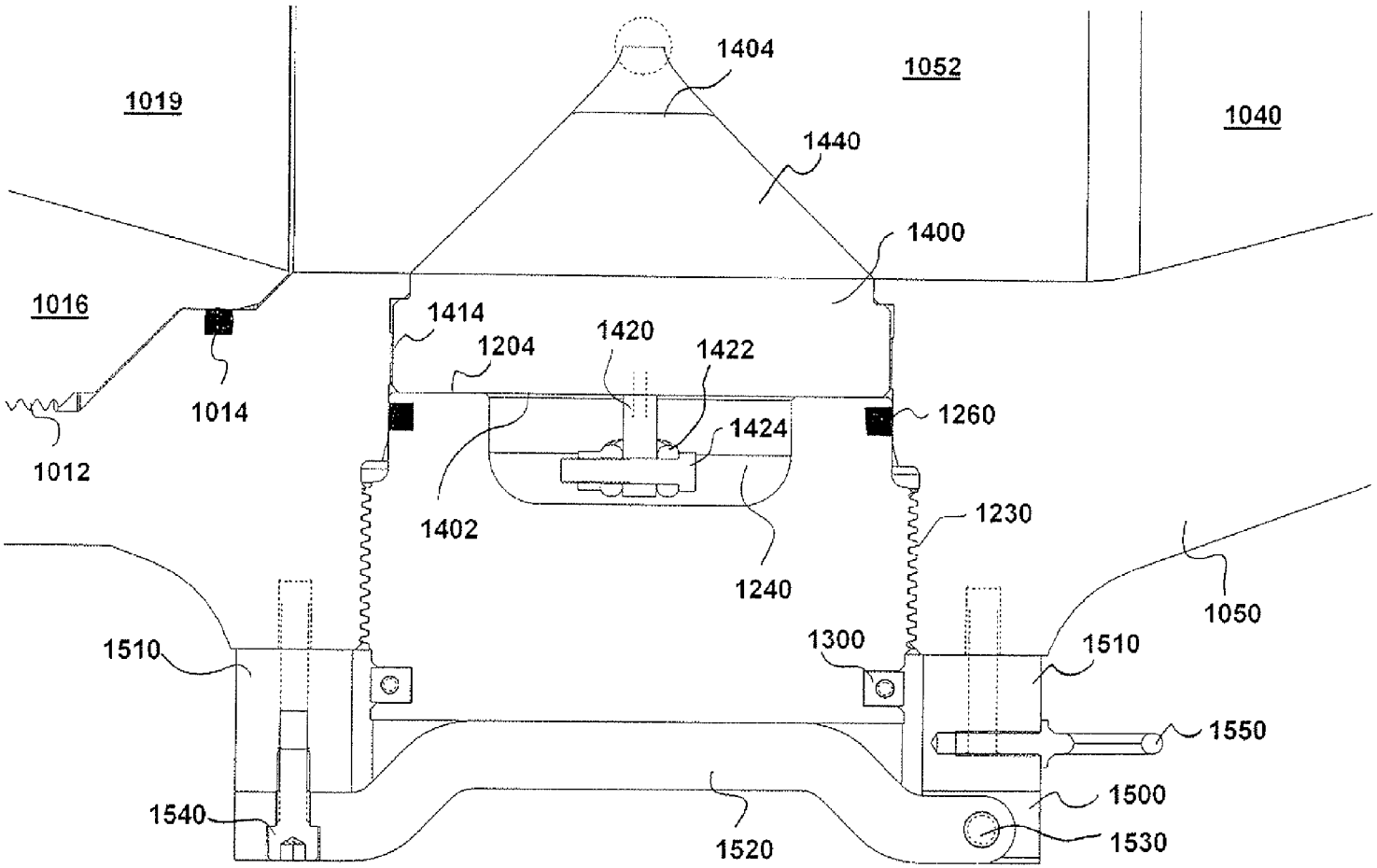
FIG. 16 shows an enlarged view of FIG. 15.
Figure 17:
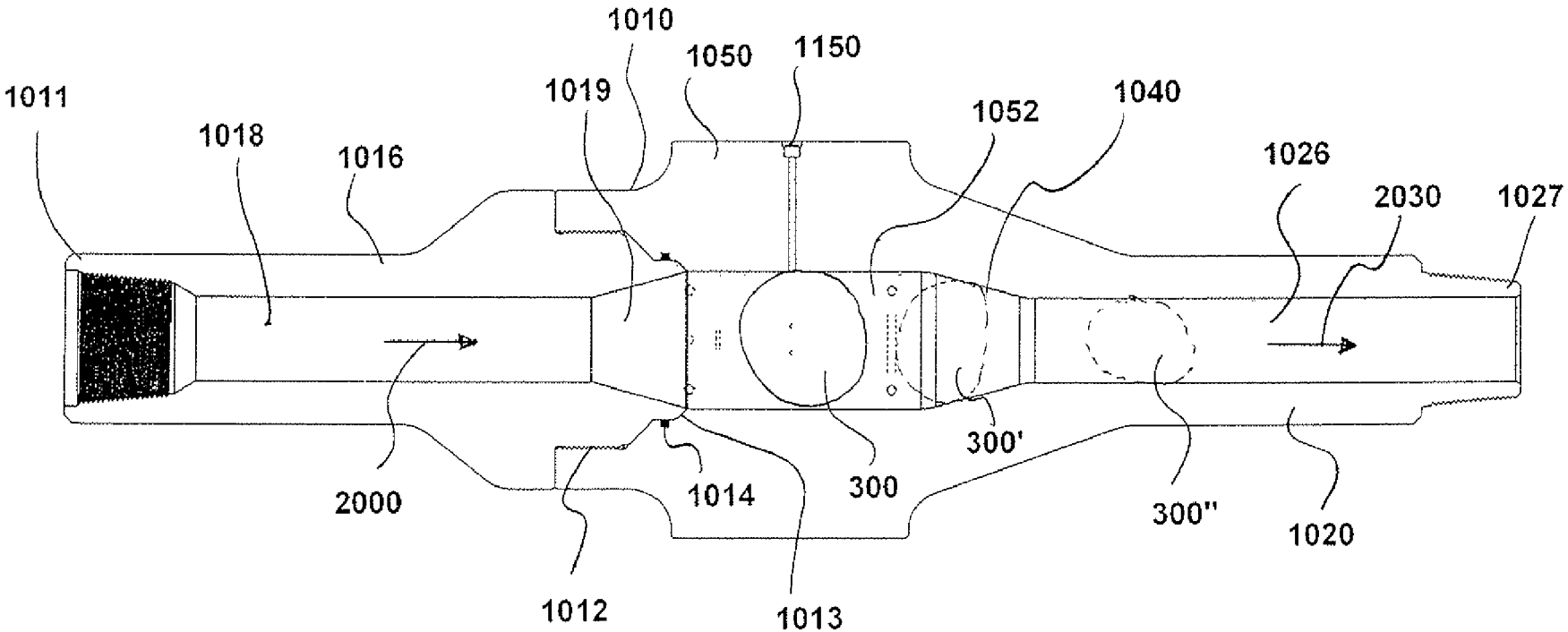
FIG. 17 shows a sectional view of the loading sub of FIG. 10 taken along the lines 17-17.

FIG. 15 shows a sectional view of loading sub 1000 taken along the lines 15-15 of FIG. 10. FIG. 16 shows an enlarged view of FIG. 15. FIG. 17 shows a sectional view of loading sub 1000 taken along the lines 17-17 of FIG. 10. FIG. 18 shows a perspective sectional view of loading sub 1000 taken along the lines 18-18 of FIG. 10. FIG. 19 shows a perspective view of loading sub 1000 with cap 1200, insert 1400, and top sub portion 1016 removed.

Loading sub 1000 can comprise upper end 1010 and lower end 1020, and between these can be an enlarged area 1050. Upper end 1010 can be fluidly connected to lower end 1020 through openings 1018, 1019, 1052, 1040, and 1026. Side entry port 1100 can be fluidly connected to enlarged opening 1052.

Loading sub 1000 can be used in any of the previous method and/or apparatus embodiments.

Figure 20:
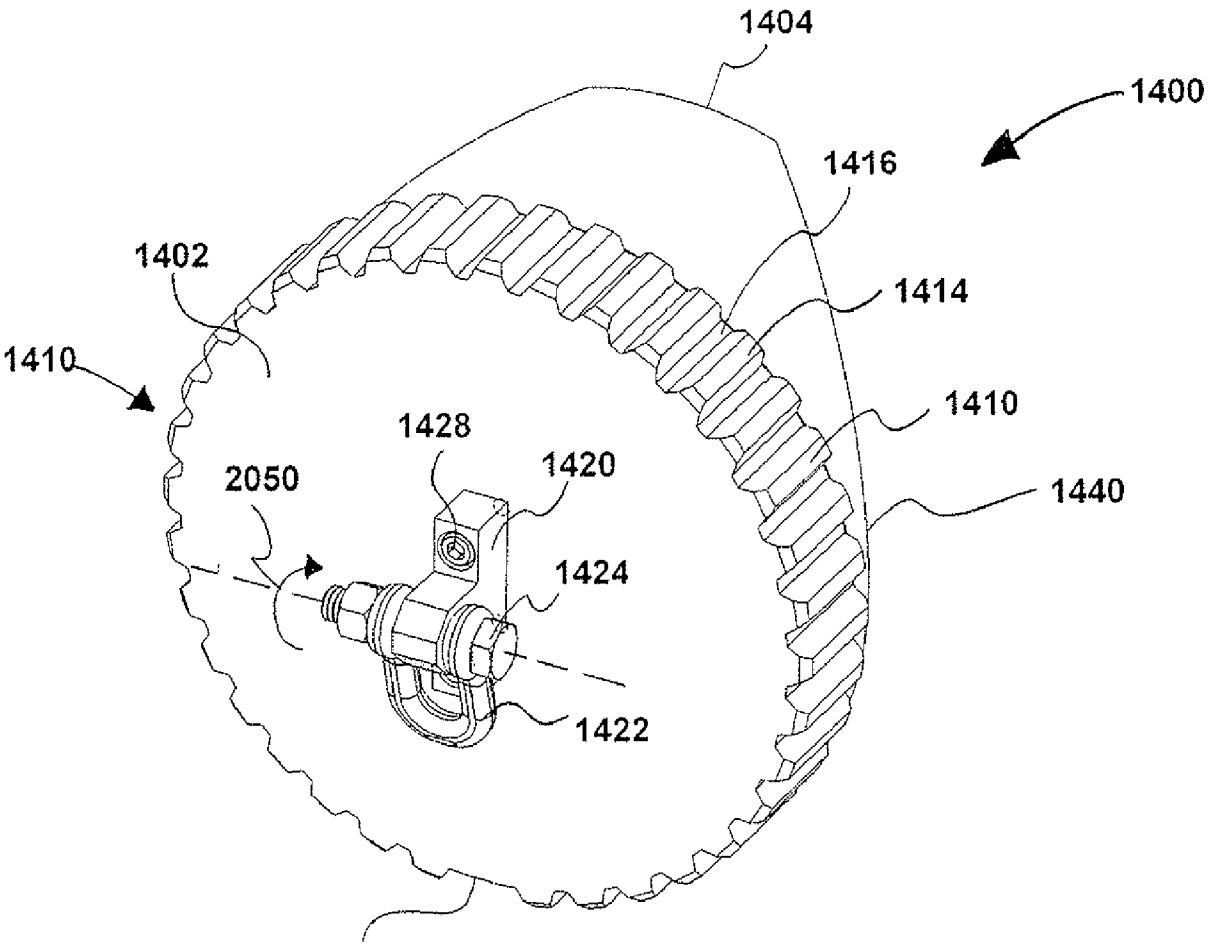
FIG. 20 shows a perspective view of an insert from the top.

FIG. 20 shows a perspective view of insert 1400 from the top. Insert 1400 can comprise upper end 1402 and lower end 1404. At the upper end 1402 can be upper formation 1410 for properly positioning insert 1400 into loading sub 1000 and side entry port 1100. At lower end 1404 can be an open area 1440 which, when insert 1400 is properly positioned in side entry port 1100, open area 1440 will conform to the internal bore of loading sub 1000 to remove restrictions or snags for movement through side entry sub. Upper formation 1410 can comprise plurality of grooves 1412 and plurality of ridges 1414 which can interconnect with a plurality of grooves 1120 and ridges 1130 in side entry port 1100 (see FIG. 20). A positioning groove 1416 can be used with positioning ridge 1140 (see FIG. 20) to position insert 1400 in side entry port. A handle 1420 can be used to place and remove insert 1400 in and from side entry port 1100. Handle 1420 can include connector 1422 which can be pivotally attached to handle 1420 through threaded fastener 1424. A plurality of fasteners can be used to connect handle 1420 to insert 1400.

Figure 21:
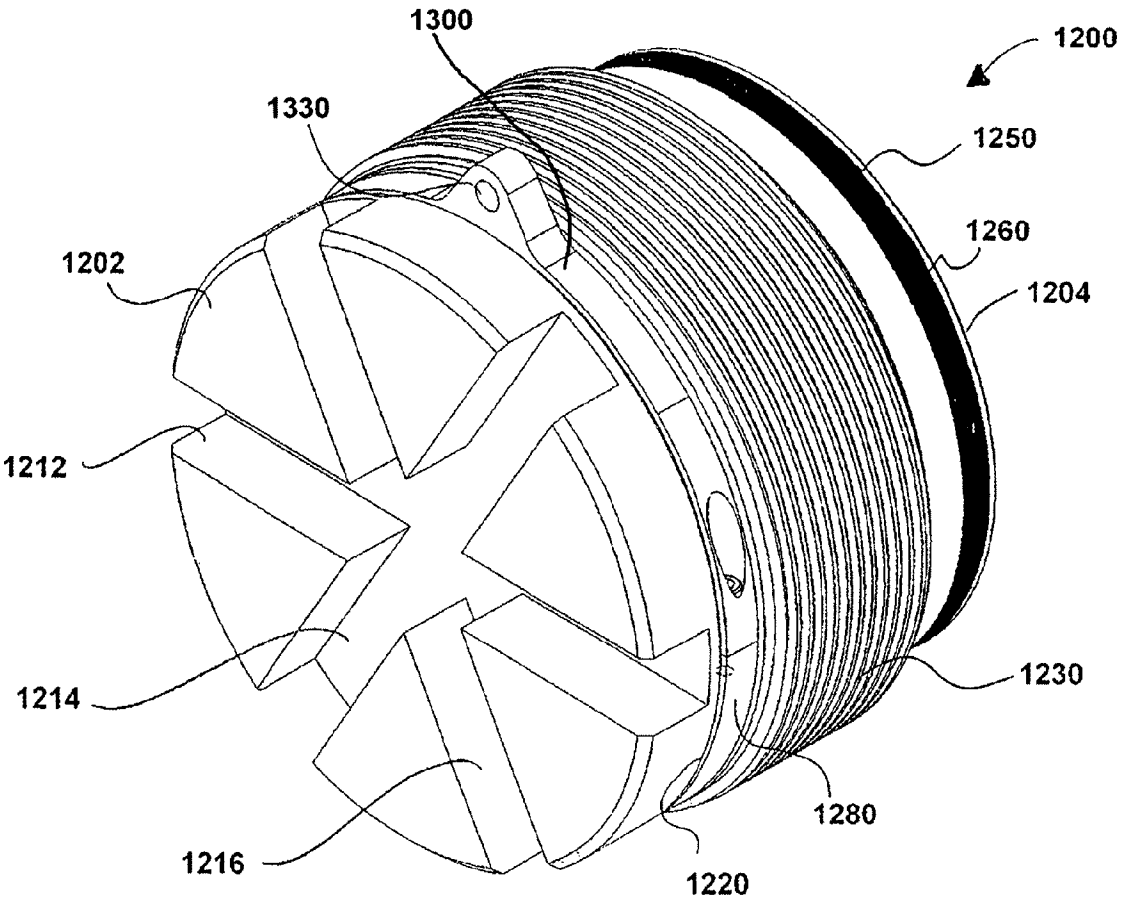
FIG. 21 shows a perspective view of a cap from the top.
Figure 22:
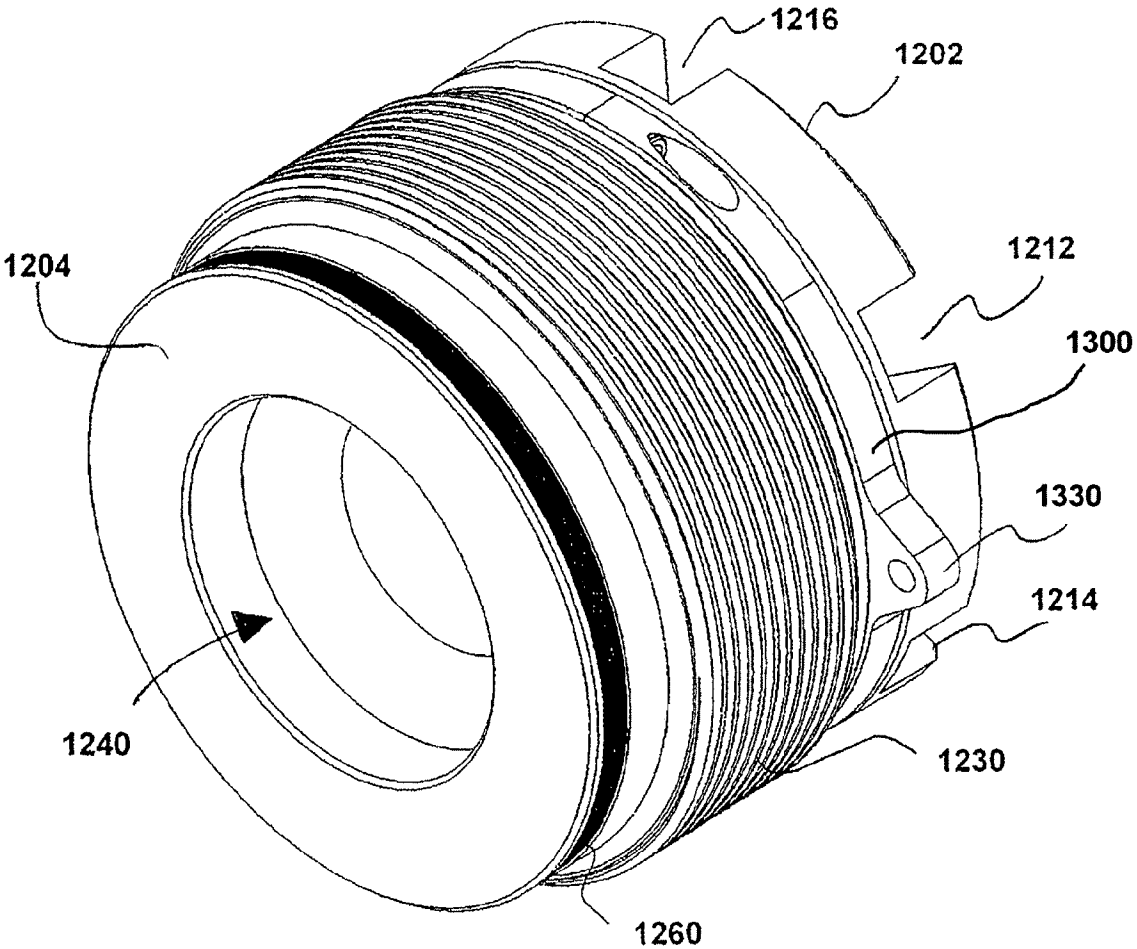
FIG. 22 shows a perspective view of a cap from the bottom.

FIG. 21 shows a perspective view of cap 1200 from the top. FIG. 22 shows a perspective view of cap 1200 from the bottom. Side entry cap 1200 can include upper end 1202 and lower end 1204. In between upper and lower ends can be a threaded area 1230. At upper end 1202 can be upper formation 1210 for locking in position cap 1200 in side entry port 1100. Upper formation can include a plurality of grooves 1212, 1214, and 1216 which, in connection with quick release/quick lock 1500 allow cap 1200 to be locked while in side entry port 1100. Adjacent to upper end 1202 is shown peripheral groove 1220 which can be used for connecting lanyard clamp 1300. Lower end can include recessed area 1240 which allows space for handle 1420 of insert 1400. Adjacent to lower end 1204 is shown peripheral groove 1250 wherein seal 1260 can be placed. Seal 1260 can be used to make a fluid tight seal with side port 1100 when cap 1200 is threaded into side port 1100.

Figure 23:
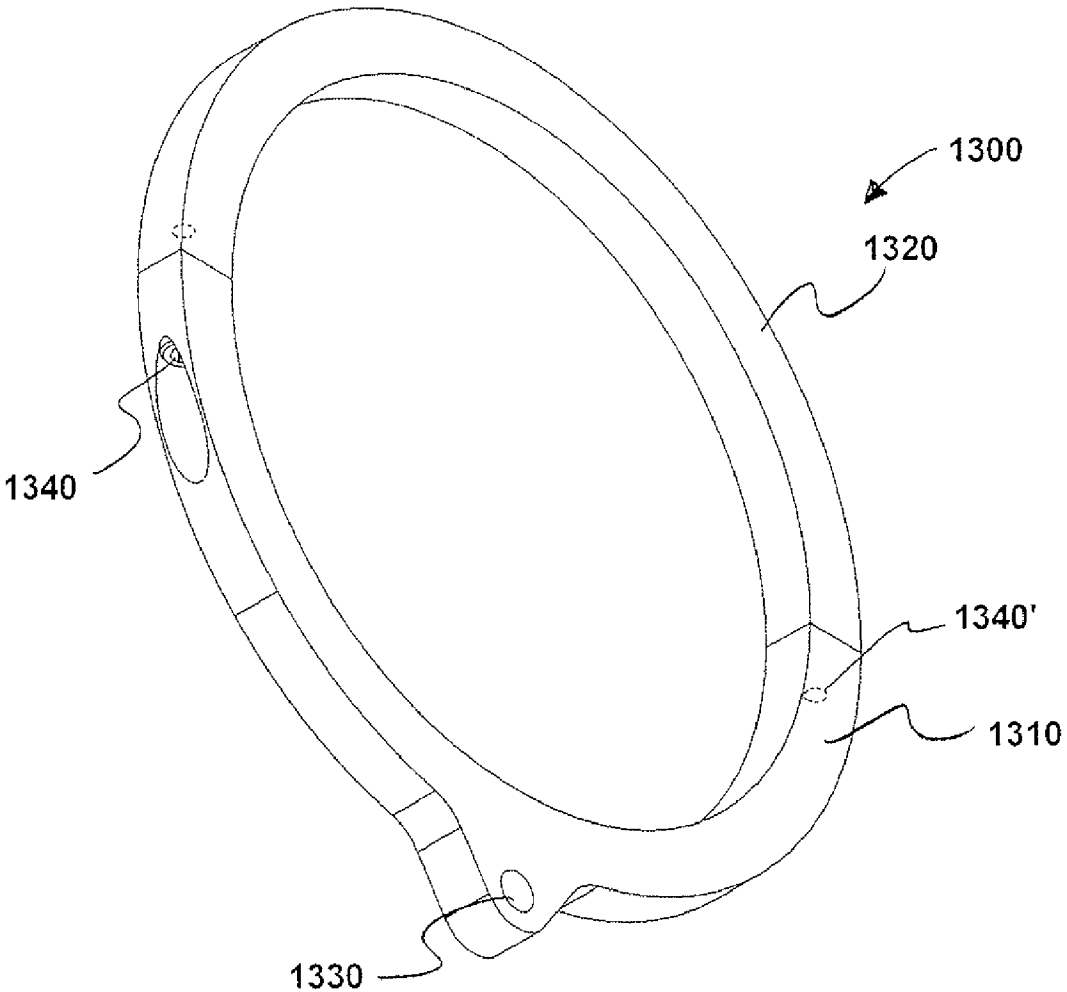
FIG. 23 shows a perspective view of a lanyard collar.

FIG. 23 shows a perspective view of lanyard collar 1300. Lanyard collar 1300 can comprise first piece 1310, second piece 1320, and lanyard connection 1330. First and second pieces 1310, 1320 can be connected by a plurality of fasteners 1340, 1340'. Lanyard collar 1300 can sit in peripheral recess 1220 of cap 1200.

Using loading sub housing 500 pump down means 300 can be placed in sub 500 while sub 500 is connected to drill or well string 20.

A seal 1260 or o-ring can be used to assist in making a seal. To control fluid flow and/or minimize any fluid leakage from above or below loading sub 1000, valves can be placed both above and below sub 1000. To reduce any latent pressure in the line, before removing side entry cap 1200, bleeder valve 1150 can be used to relieve pressure inside sub 1000.

Pump down means 300 can be inserted into enlarged area 1052 by removal of side entry cap 1200 and insert 1400. Side entry cap 1200 can be threadably connected to side entry port 1100 and provide a seal when tightened. Insert 1400 can be connectable to side entry port 1100 through a plurality of grooves 1416 and ridges 1414 which fit with a plurality of grooves 1120 and ridges 1130 of loading sub 1000. An open area 1440 for insert 1400 can be used which causes enlarged area 1052 to have a smooth and uniform surface thereby avoiding a tendency of items to stick or get caught when passing through enlarged area 1052.

In FIG. 15, although pump down means 300 is shown as not being squeezed or deformed while in enlarged area 1050

(and/or enlarged area 1052). However, pump down means 300 and enlarged area 1050 (and/or enlarged opening 1052) can be sized such that pump down means can be inserted requiring squeezing or deforming and/or deflecting of pump down means 300 to enter enlarged area 1050 and/or enlarged opening 1052. Transition area 1040 can be used to provide a transition to a bore of diameter similar to the bore of the downhole drill string.

The smaller size of opening 1042 in relation to pump down means 300 will tend to keep pump down means 300 in enlarged area 1050 and/or enlarged opening 1052 (and thereby in loading sub 1000) until desired. To move pump down means down fluid is pumped in the direction of arrow 2000 which will tend to push pump down means 300 also in the direction of arrow 2000 until pump down means enters transition area 1040. Transition area 1040 will cause pump down means 300 to deflect and move downwards in the directions of arrows 2010 and 2030. Continued pumping of fluid will cause pump down means to move downhole to a desired point.

In one embodiment, pump down means 300 can be inserted into enlarged opening 1052 through side entry port 1100. In FIG. 19, arrow 2060 schematically indicates the insertion of pump down means 300 into enlarged opening 1052 through side entry port 1100. To allow such insertion both cap 1200 and insert 1400 should be removed from side entry port 1100 (which are not shown in FIG. 19 for clarity). Additionally, not shown in FIG. 19 for clarity is quick release/quick lock 1500 or cross over sub 1016.

In one embodiment, quick release/quick lock 1500 is used to lock cap 1200 in place in side entry port 1100. In one embodiment quick release/quick lock 1500 uses a pivoting action for locking/unlocking. In one embodiment a frictional lock/release is used. In one embodiment other types of locking/releasing mechanisms are used such as magnetic, clip, snap, lever, adhesive, etc.

In one embodiment with the method cap 1200 is removed from side entry port 1100, but connected to loading sub 1000 via a lanyard while insert 1400 is also being removed from side entry port 1100.

In one embodiment insert 1400 is pulled out of side entry port 1100 through handle 1420. In one embodiment, at least partly during the time period insert 1400 is located outside of side entry port 1100, insert 1400 is prevented from falling down by being connected, such as to the rig, cable, sub 1000, and/or the person operating loading sub 1000. In one embodiment, handle 1420 of insert 1400 is used to make the connection. In one embodiment handle 1420 includes connected 1422 and connector 1422 is pivotally connected to handle 1420 through fastener 1424. Arrow 2050 schematically indicates pivotal motion of connector 1422.

In one embodiment, insert 1400 can be rotatably connected to side entry port 1100 such that it can rotate with respect to side entry port 1100 to provide a temporary restriction in enlarged opening 1050. One manner of obtaining this is to connect insert 1400 to cap 1200 (such as by fasteners or making the two one piece). In this embodiment all valleys and grooves can be removed from insert 1400 and/or side entry port 1100. To rotate insert 1400 (when connected to cap 1200) cap 1200 is rotated—thereby rotating lower ends 1404 of insert 1400.

In one embodiment cross over sub 1016 can be connected to upper end 1010 of loading sub 1000 through threaded area 1012. Cross over sub 1016 can include tip 1011, end 1013, opening 1018, and second opening 1019. Cross over sub 1016 can be sealed to loading sub 1000 through seal 1014.

FIGS. 15 and 17 schematically show pump down means 300 moving from enlarged opening 1052 (pump down means 300), through transition area 1040 (pump down means 300'), and downhole into opening 1026 (pump down means 300") and ultimately further downhole for a desired purpose (past tip 1027). Arrow 200 schematically indicates the direction of fluid flow. Pump down means 300' is shown as being squeezed in transition area 1040 (conforming to the shape of this area), and squeezed further in opening 1026 (conforming to the shape of this area).

In one embodiment the following dimensions can be used: overall longitudinal length of sub 1000 and crossover sub 1016 being 74.03 inches (188.04 centimeters). Overall external diameter of enlarged area 1050 being 10 inches (25.4 centimeters) with side entry port 1100 being 6.875 inches (17.46 centimeters) in diameter. Internal diameter of opening 1026 of lower end 1020 being 4.25 inches (10.8 centimeters). The pin end can be a 6.625 FH connection. Box end can be a 6.625 FH box connection.

The following is a list of reference numerals:

LIST FOR REFERENCE NUMERALS

| (Reference No.) | (Description) |
|---|---|
| 1 | rig |
| 2 | crown block |
| 3 | cable means |
| 4 | traveling block |
| 5 | hook |
| 6 | gooseneck |
| 7 | swivel |
| 8 | drilling fluid line |
| 10 | top drive unit |
| 11 | draw works |
| 12 | cable |
| 13 | rotary table |
| 14 | well bore |
| 15 | guide rail |
| 16 | support |
| 17 | support |
| 18 | drill pipe |
| 19 | drill string |
| 20 | drill string or work string |
| 22 | valve |
| 24 | valve |
| 30 | swivel |
| 31 | hose |
| 100 | sub |
| 110 | upper end |
| 112 | threaded area |
| 120 | lower end |
| 122 | threaded area |
| 150 | enlarged area |
| 160 | transition area |
| 170 | reduced area |
| 200 | dimension line |
| 210 | dimension line |
| 220 | dimension line |
| 230 | dimension line |
| 240 | dimension line |
| 300 | pump down means |
| 310 | insertion point |
| 500 | sub |
| 510 | upper end |
| 512 | threaded area |
| 520 | lower end |
| 522 | threaded area |
| 550 | enlarged area |
| 560 | transition area |
| 570 | reduced area |
| 580 | upper area |
| 600 | side entry cap |
| 610 | side entry port |
| 650 | bleeder valve |

-continued

LIST FOR REFERENCE NUMERALS

| (Reference No.) | (Description) |
|---|---|
| 1000 | sub |
| 1010 | upper end |
| 1011 | tip |
| 1012 | threaded area |
| 1013 | end |
| 1014 | seal |
| 1016 | cross over sub |
| 1018 | opening |
| 1019 | opening |
| 1020 | lower end |
| 1022 | threaded area |
| 1026 | opening |
| 1027 | tip |
| 1040 | transition area |
| 1042 | opening |
| 1050 | enlarged area |
| 1052 | enlarged opening |
| 1056 | diameter of enlarged opening |
| 1057 | diameter of transition opening |
| 1058 | diameter of lower opening |
| 1060 | transition area |
| 1070 | reduced area |
| 1080 | upper area |
| 1090 | venting port |
| 1100 | side entry port |
| 1110 | threaded area |
| 1120 | plurality of grooves |
| 1130 | plurality of ridges |
| 1140 | positioning ridge |
| 1200 | side entry cap |
| 1202 | upper end |
| 1204 | lower end |
| 1210 | upper formation |
| 1212 | groove |
| 1214 | groove |
| 1216 | groove |
| 1220 | peripheral groove |
| 1230 | threaded area |
| 1240 | recessed area |
| 1250 | peripheral groove |
| 1260 | seal |
| 1300 | lanyard clamp |
| 1310 | first piece |
| 1320 | second piece |
| 1330 | lanyard connection |
| 1340 | fasteners |
| 1380 | lanyard |
| 1400 | insert |
| 1402 | upper end |
| 1404 | lower end |
| 1410 | upper formation |
| 1412 | plurality of grooves |
| 1414 | plurality of ridges |
| 1416 | positioning groove |
| 1420 | handle |
| 1422 | connector |
| 1424 | fastener |
| 1428 | plurality of fasteners |
| 1440 | open area |
| 1500 | quick release/lock |
| 1510 | base |
| 1512 | fastener |
| 1520 | arm |
| 1530 | pivot point |
| 1540 | locking fastener |
| 1550 | lanyard connector |
| 2000 | arrow |
| 2010 | arrow |
| 2020 | arrow |
| 2050 | arrow |
| 2060 | arrow |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A method of pumping a pump down means in a well, the method comprising the steps of:

(a) positioning a loading sub housing above the well, the housing comprising a main body section having upper and lower portions; a main passage through the main body section from the upper portion to the lower portion; an enlarged area located in the main passage; a side entry port providing access to the enlarged area; and a reduced area located in the main passage downstream of the enlarged area and fluidly connected to the enlarged area, the reduced area having a smaller cross sectional area than the enlarged area, a side entry cap detachably connected to the side entry port;

(b) detaching the side entry cap, and inserting a wiper ball into the enlarged area through the side entry port, and attaching the side entry cap to the side entry port, wherein the wiper ball is temporarily held within the enlarged area and blocking fluid flow in the main passage;

(c) inserting the loading sub housing into a drill or well string;

(d) after step "c", applying upstream pressure to pump the wiper ball into the drill or well string.

2. The method of claim 1, wherein step "c" is performed after step "b."

3. The method of claim 2, wherein step "c" is performed before step "b."

4. The method of claim 3, wherein in step "a" the loading sub housing has a transitional area between the enlarged area and the reduced area.

5. The method of claim 4, wherein the transitional area is frustoconically shaped.

6. The method of claim 1, wherein in step "b" the wiper ball is at least temporarily restrained from movement into the reduced area.

7. The method of claim 1, wherein in step "b" the wiper ball is comprised of an elastomeric material.

8. The method of claim 1, wherein in step "b" the enlarged area is sized to accommodate without deforming the wiper ball.

9. The method of claim 1, wherein a second wiper ball is placed in the loading sub housing and upstream pressure is applied to pump the second wiper ball into the drill or well string.

* * * * *